US005172687A

United States Patent [19]

Donnerhack et al.

[11] Patent Number: 5,172,687

[45] Date of Patent: Dec. 22, 1992

[54] TREATMENT CHAMBER FOR PERFORMING THERAPEUTIC PROCEDURES

[75] Inventors: Andreas Donnerhack, Krefeld; Ralf Igelhorst, Dusseldorf; Klemens Thoma, Krefeld-Huls, all of Fed. Rep. of Germany

[73] Assignee: Messer Griesheim GmbH, Frankfort, Fed. Rep. of Germany

[21] Appl. No.: 605,971

[22] Filed: Oct. 30, 1990

[30] Foreign Application Priority Data

Nov. 24, 1989 [DE] Fed. Rep. of Germany ..... 3938889

[51] Int. Cl.[5] ..... A61G 10/00; A61H 33/06

[52] U.S. Cl. ..... 128/205.26; 128/371; 128/367

[58] Field of Search ..... 128/204.18, 204.21, 128/204.26, 202.12, 205.11, 205.26, 367, 371-375, 204.15, 204.17

[56] References Cited

U.S. PATENT DOCUMENTS

| | | | |
|---|---|---|---|
| 113,536 | 4/1871 | Leland et al. | 128/202.12 |
| 300,246 | 6/1884 | Goldberg | 128/367 |
| 314,453 | 3/1885 | Ketchum | 128/202.12 |
| 375,015 | 12/1887 | Smith | 128/202.12 |
| 1,933,733 | 11/1933 | Hess | 128/373 |
| 2,385,683 | 9/1945 | Burton | 128/202.12 |
| 2,693,178 | 11/1954 | Gilroy | 128/204.26 |
| 2,821,982 | 2/1958 | Lyburn | 128/371 |
| 3,547,118 | 12/1970 | Kolman et al. | 128/205.26 |
| 3,552,141 | 1/1971 | Valenta | 128/204.15 |
| 3,863,630 | 2/1975 | Cavallo | 128/204.21 |
| 4,215,681 | 8/1980 | Zalkin et al. | 128/204.21 |
| 4,481,944 | 11/1984 | Bunnell | 128/204.18 |
| 4,510,930 | 4/1985 | Garcia | 128/202.22 |
| 4,633,859 | 1/1987 | Reneau | 128/205.26 |
| 4,781,184 | 11/1988 | Fife | 128/205.12 |
| 4,928,685 | 5/1990 | Gray | 128/205.24 |
| 4,955,373 | 9/1990 | Maguire, III | 128/205.27 |

*Primary Examiner*—Edgar S. Burr
*Assistant Examiner*—Stephen R. Funk
*Attorney, Agent, or Firm*—Connolly & Hutz

[57] ABSTRACT

A temperable treatment chamber for performing therapeutic procedures for patients includes a gas supply unit located outside of the chamber for a breathable gas with at least one inhalation site opening into the patient treatment chamber. An activation device is located inside the chamber for controlling the supply of the breathable gas by the patient.

1 Claim, 1 Drawing Sheet

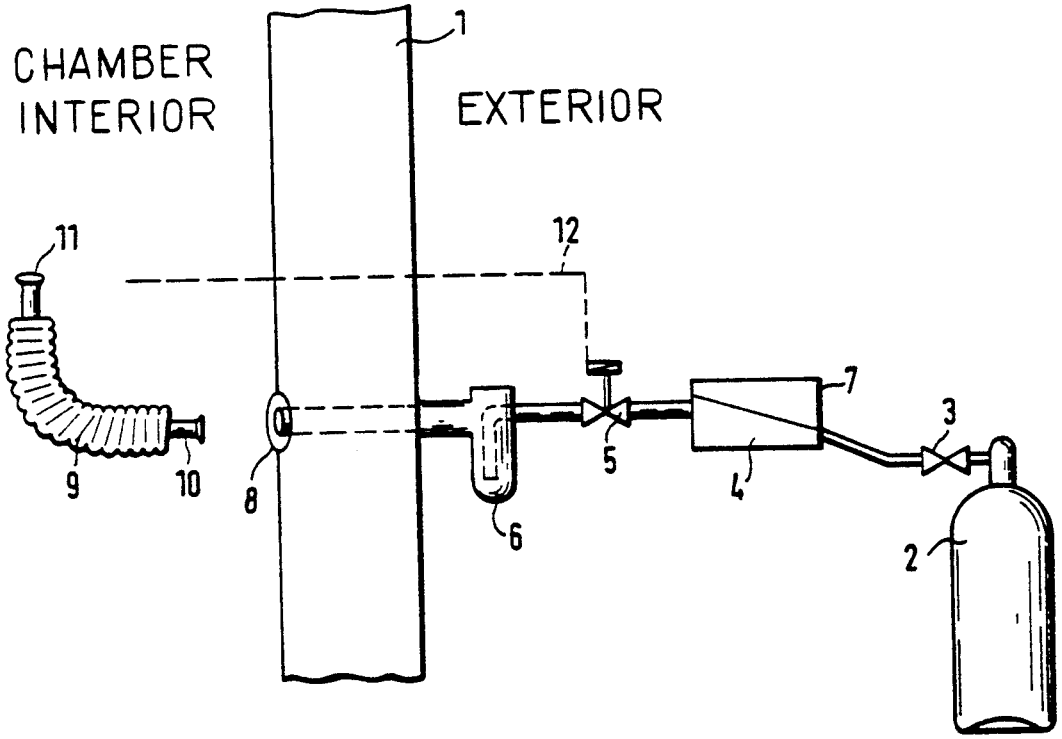
CHAMBER
INTERIOR
EXTERIOR
1
11
12
7
3
9
10
8
5
4
6
2

TREATMENT CHAMBER FOR PERFORMING THERAPEUTIC PROCEDURES

BACKGROUND OF THE INVENTION

Cold or heat treatments in temperable treatment chambers are generally known as therapeutic procedures in physical therapy. They are felt to be an effective approach for numerous kinds of indications. Such treatments range from the purely medical-therapeutic realm, e.g. cold applications for rheumatic diseases, all the way to the realm of prophylaxis and physical fitness, e.g. heat application in saunas. Consequently, the term "patient" is used below according to the invention to also refer to healthy persons who merely use such installations for reasons of prophylaxis or physical fitness. Moreover, it is also known that there is an increased oxygen demand as an immediate or subsequent reaction to a cold or heat treatment. Furthermore, it is also known that, with certain indications, an elevated oxygen supply likewise has a therapeutic as well as an overall performance-enhancing effect. Such an improved oxygen supply could be achieved by enriching the atmosphere in the treatment chamber with oxygen. However, for safety reasons, this poses problems and would require complex technical safety measures.

SUMMARY OF INVENTION

Therefore, the invention is based on the task of creating a temperable treatment chamber which makes it possible to provide the patient with a breathable gas enriched with oxygen without appreciably enriching the chamber atmosphere with oxygen.

The invention is based on the idea of equipping the treatment chamber with a gas supply unit from which the breathable gas can be inhaled in the desired composition. This inhalation only becomes possible when the patient so desires and activates a triggering mechanism that controls the supply of the breathable gas. When the chamber is equipped for treating several patients at the same time, a corresponding number of inhalation sites can be installed. The breathable gas is inhaled by the patient through a tube or pipe to which disposable mouthpieces or a partial or full-face mask is connected.

In its simplest form, the gas supply unit consists of a gas tank, a pressure reducer and an adjustable ON-OFF valve. The ON-OFF valve is actuated via a signal given by the patient and can be triggered mechanically, electrically or preferably pneumatically. The pneumatic control is advantageous in that it can be triggered by the negative pressure that occurs during inhalation. In this manner, it is ensured that only so much breathable gas enters the tube end piece as the patient needs. Hence, the chamber atmosphere cannot become enriched with oxygen.

Between the controllable ON-OFF valve and the inhalation site, it is advantageously possible to install a breathing air humidifier, by means of which moisture or other components such as fragrances or medications can be added. The gas supply unit can also be equipped with a gas mixing device which allows the admixture of additional gaseous components, in order to produce a breathable gas of any desired composition. In the simplest case, the gas can come from a pressurized gas cylinder, but it is also possible to set up the gas supply from insulated tanks containing liquefied gas via subsequent evaporators. The supply can also come from an enrichment system for individual gas components from the atmosphere.

In an especially advantageous embodiment, in particular for gas supply units located outside of the treatment chamber, the inhalation site is designed as a plug-in connector to hook up a tube or pipe with a disposable mouthpiece or face mask. The plug-in connector is designed in such a way that gas can only be inhaled when the tube or pipe is connected. In an especially simple manner, it is possible to implement a pneumatic control of the ON-OFF valve on the basis of the negative pressure that occurs when the patient inhales. If there are several plug-in connectors, they are designed in such a way, for example, with a spring-laden seal, that gas can only flow through the plug-in connector when the tube or pipe is connected. In this case, the patient can move around freely in the treatment chamber and can use the supply of breathable gas at any inhalation site. In this case, breathable gas cannot escape from other inhalation sites. Accordingly, this also applies to the treatment of several patients in a treatment chamber.

THE DRAWING

The single FIGURE schematically illustrates an embodiment of the invention.

DETAILED DESCRIPTION

The wall of a treatment chamber 1 is shown as well as a gas supply unit located outside of the treatment chamber 1. Only one wall is illustrated for chamber 1 since this is the wall which contains humidifier 6 and the connector 8. Obviously, changer 1 would include other walls on the left-hand portion of hose 9. Thus, the wall divides the exterior from the interior of the chamber in the area where the various equipment is installed. The gas supply unit consists of a compressed gas cylinder 2 for oxygen, a pressure reducer 3, a gas mixing device 4, a controllable ON-OFF valve 5 and a breathing-air humidifier 6. In the gas mixing device 4, additional components, for example, nitrogen, are added through the pipeline 7 to the oxygen inhaled from the compressed gas cylinder 2. The pressure reducer 3 is designed in such a manner that the amount of gas administered to the patients and the gas pressure are independent of the feed pressure from the compressed gas cylinder 2.

According to the invention, the gas supply unit ends in a plug-in connector 8 in the wall of the treatment chamber 1. A hose 9 with a connector counterpart 10 can be plugged into the plug-in connector 8. At the other end of the hose 9, there is a disposable mouthpiece 11. The supply of the breathing gas is started and controlled via a signal triggered by the patient. This can be done in many different ways and is symbolically indicated by the control segment 12. Preferably, the ON-OFF valve 5 is automatically activated and controlled by the negative pressure that occurs when the patient inhales.

SUMMARY

Cold and heat treatments as therapeutic procedures are performed in treatment chambers. In the case of certain indications, an elevated oxygen content in the gas inhaled by the patient is desired. Enriching the atmosphere of the treatment chamber with oxygen is questionable for safety reasons. However, in order to nevertheless be abler to provide the patient with a breathable gas enriched with oxygen, there is a gas supply unit outside of the treatment chamber. A line leads from the gas supply unit to an inhalation site in the chamber from which the patient can inhale the breathable gas through a mouthpiece or a face mask. An activation device in the chamber makes it possible for the patient to control the supply of the treatment gas. This is preferably done by means of the negative pressure that occurs when the patient inhales.

What is claimed is:

1. A method of using a sauna treatment chamber comprising the user entering the chamber, directly breathing the chamber atmosphere, periodically applying a mouthpiece connected to a gas supply containing oxygen enriched gas outside the chamber with the gas supply connected to an inhalation site in the wall of the chamber and with the mouthpiece connected to the inhalation site, inhaling while the mouthpiece is applied to create a negative pressure which opens flow communication with the gas supply in response to the inhaling to breathe in a breathable gas from the gas supply which differs from the chamber atmosphere, periodically removing the mouthpiece to stop the flow of gas to the mouthpiece, the user then moving freely in the treatment chamber, and the user then again applying the mouthpiece to breathe in additional oxygen enriched gas.

* * * * *